US005082119A

United States Patent [19]

Bingley

[11] Patent Number: 5,082,119

[45] Date of Patent: Jan. 21, 1992

[54] SECURITY PEN AND PENCIL CADDY APPARATUS

[76] Inventor: Lawrence J. Bingley, 9910 S. Prospect, Chicago, Ill. 60643

[21] Appl. No.: 634,745

[22] Filed: Dec. 24, 1990

[51] Int. Cl.[5] ..... E05B 73/00

[52] U.S. Cl. ..... 211/4; 211/69.1

[58] Field of Search ..... 211/4, 69, 69.1; 70/158, 163, 166, 170, 63; 248/206.5, 683, 551

[56] References Cited

U.S. PATENT DOCUMENTS

| | | | |
|---|---|---|---|
| 816,959 | 4/1906 | Briganti | 211/69 X |
| 1,357,063 | 10/1920 | Korb | 211/69 X |
| 2,146,968 | 2/1939 | Macogno | 70/170 |
| 2,192,569 | 3/1940 | Williams | 248/206.5 X |
| 2,644,212 | 7/1953 | Markowitz | 248/206.5 X |
| 2,907,085 | 10/1959 | Bosland | 248/685 X |
| 2,952,498 | 9/1960 | Powers et al. | 211/69 X |
| 3,104,052 | 9/1963 | Nemsky | 70/163 X |
| 4,651,544 | 3/1987 | Hungerford | 70/63 |
| 4,934,527 | 6/1990 | Ho | 211/69.1 X |
| 4,951,577 | 8/1990 | Bentley | 70/63 X |

FOREIGN PATENT DOCUMENTS

| | | | |
|---|---|---|---|
| 1251343 | 12/1960 | France | 211/69 |
| 0448202 | 3/1968 | Switzerland | 248/206.5 |

*Primary Examiner*—Blair M. Johnson
*Attorney, Agent, or Firm*—Leon Gilden

[57] ABSTRACT

An elongate longitudinally aligned support housing is mounted to a support base, with the base including a solenoid operative through an entry code to effect retraction of an associated solenoid rod to direct the solenoid rod to disengage from an associated piston rod support plate permitting a piston rod and piston to extend upwardly of the support housing to provide access to writing instruments contained therewithin.

5 Claims, 4 Drawing Sheets

SECURITY PEN AND PENCIL CADDY APPARATUS

BACKGROUND OF THE INVENTION

1. Field of the Invention

The field of invention relates to writing instrument support structure, and more particularly pertains to a new and improved security pen and pencil caddy apparatus wherein the same provides selective containment and exposure of writing instruments for access thereto upon entry of appropriate code data within the apparatus.

2. Description of the Prior Art

Various caddy structure has been provided in the prior art to provide support for writing instruments. Frequently, however, such instruments are lost due to intentional or unintentional removal of the instruments from the associated containment structure. The instant invention attempt to overcome deficiencies of the prior art by providing access to the writing instruments only upon entry of a code to permit access to the writing instruments. Examples of the prior art include U.S. Pat. No. 4,736,853 to O'Mara wherein a pen and pencil holder is provided with various pockets and slots for securement of the writing instruments therewithin.

U.S. Pat. No. 4,779,742 to Starkweather sets forth an article holder configured as a pocket member for securement of various writing instruments and components therewithin.

U.S. Pat. No. 4,815,483 to Dugrenier sets forth a container with various rotatable trays mounted therewithin, with the container providing storage of various writing instruments in exposed slots.

U.S. Pat. Nos. Design 267,375 and 231,407 provide examples of variously configured writing instrument storage containers for access by individuals to the writing instruments.

As such, it may be appreciated that there continues to be a need for a new and improved security pen and pencil caddy apparatus as set forth by the instant invention which addresses both the problems of ease of use as well as convenient access to various writing instruments contained within the organization upon entry of a predetermined code.

SUMMARY OF THE INVENTION

In view of the foregoing disadvantages inherent in the known types of pen and pencil storage apparatus now present in the prior art, the present invention provides a pen and pencil caddy apparatus wherein the same utilizes a spring-biased piston that normally overlies a storage housing that is extended to provide access to the storage housing upon entry of an appropriate code within an underlying latch mechanism securing the piston in a retracted position within the housing. As such, the general purpose of the present invention, which will be described subsequently in greater detail, is to provide a new and improved pen and pencil caddy apparatus which has all the advantages of the prior art pen and pencil storage apparatus and none of the disadvantages.

To attain this, the present invention provides an elongate longitudinally aligned support housing mounted to a support base, with the base including a solenoid operative through an entry code to effect retraction of an associated solenoid rod to direct the solenoid rod to disengage from an associated piston rod support plate permitting a piston rod and piston to extend upwardly of the support housing to provide access to writing instruments contained therewithin.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved pen and pencil caddy apparatus which has all the advantages of the prior art pen and pencil storage apparatus and none of the disadvantages.

It is another object of the present invention to provide a new and improved pen and pencil caddy apparatus which may be easily and efficiently manufactured and marketed.

It is a further object of the present invention to provide a new and improved pen and pencil caddy apparatus which is of a durable and reliable construction.

An even further object of the present invention is to provide a new and improved pen and pencil caddy apparatus which is susceptible of a low cost of manufacture with regard to both materials and labor, and which accordingly is then susceptible of low prices of sale to the consuming public, thereby making such pen and pencil caddy apparatus economically available to the buying public.

Still yet another object of the present invention is to provide a new and improved pen and pencil caddy apparatus which provides in the apparatuses and methods of the prior art some of the advantages thereof, while simultaneously overcoming some of the disadvantages normally associated therewith.

Still another object of the present invention is to provide a new and improved pen and pencil caddy apparatus wherein the same provides selective access to writing instruments within a storage housing upon entry of a predetermined combination code.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
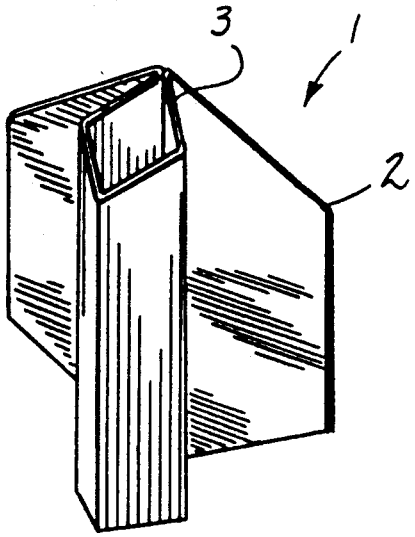
FIG. 1 is an isometric illustration of a prior art pen and pencil storage apparatus.

With reference now to the drawings, and in particular to FIGS. 1 to 9 thereof, a new and improved security pen and pencil caddy apparatus embodying the principles and concepts of the present invention and generally designated by the reference numeral 10 will be described.

FIG. 1 illustrates a prior art typical pen and pencil storage unit 1, as set forth in U.S. Pat. No. Design 267,375, wherein a support plate 2 mounts a support housing 3, with a cavity within the support housing for storage of various writing instruments.

Figure 2:
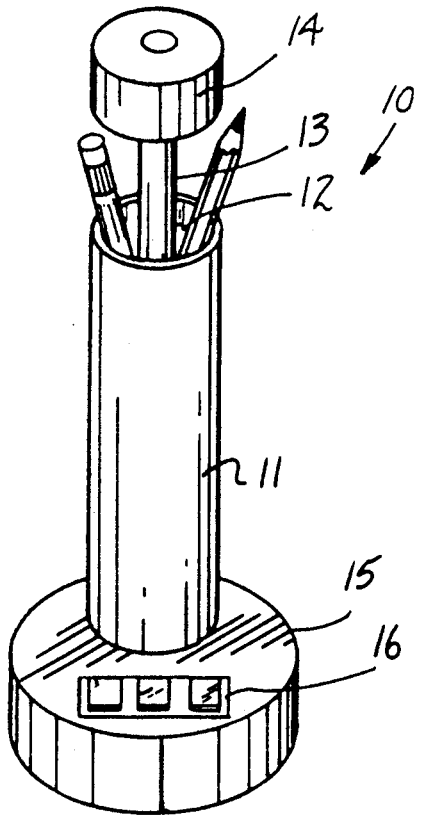
PRIOR ART FIG. 2
FIG. 2 is an isometric illustration of the instant invention.
Figure 3:
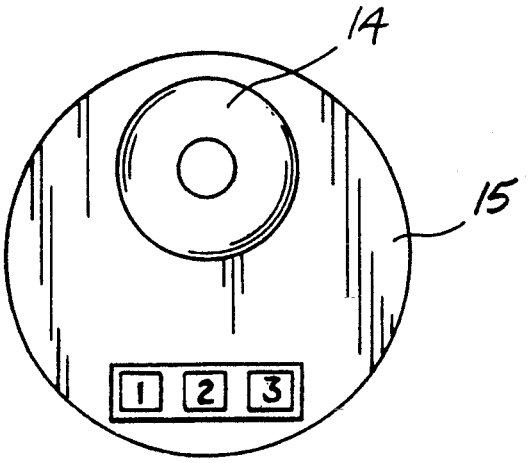
FIG. 3 is a top orthographic view of the instant invention.
Figure 4:
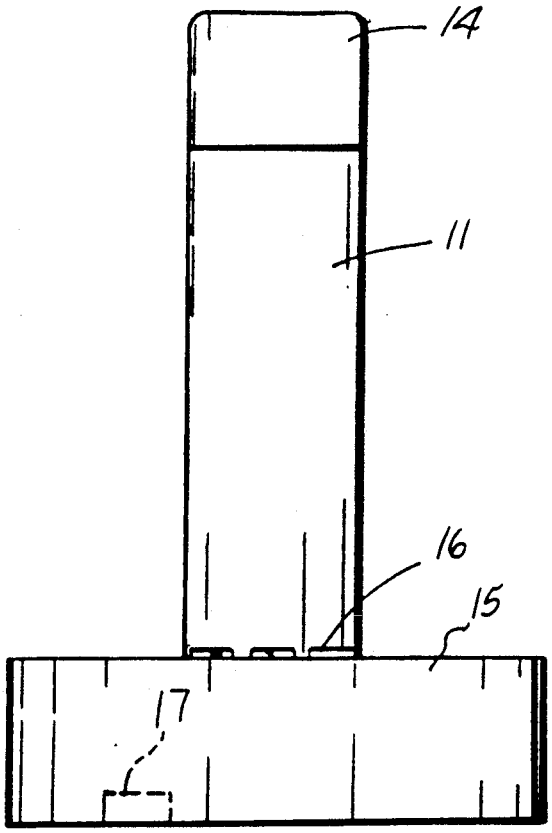
FIG. 4 is an orthographic side view, taken in elevation, of the instant invention.
Figure 5:
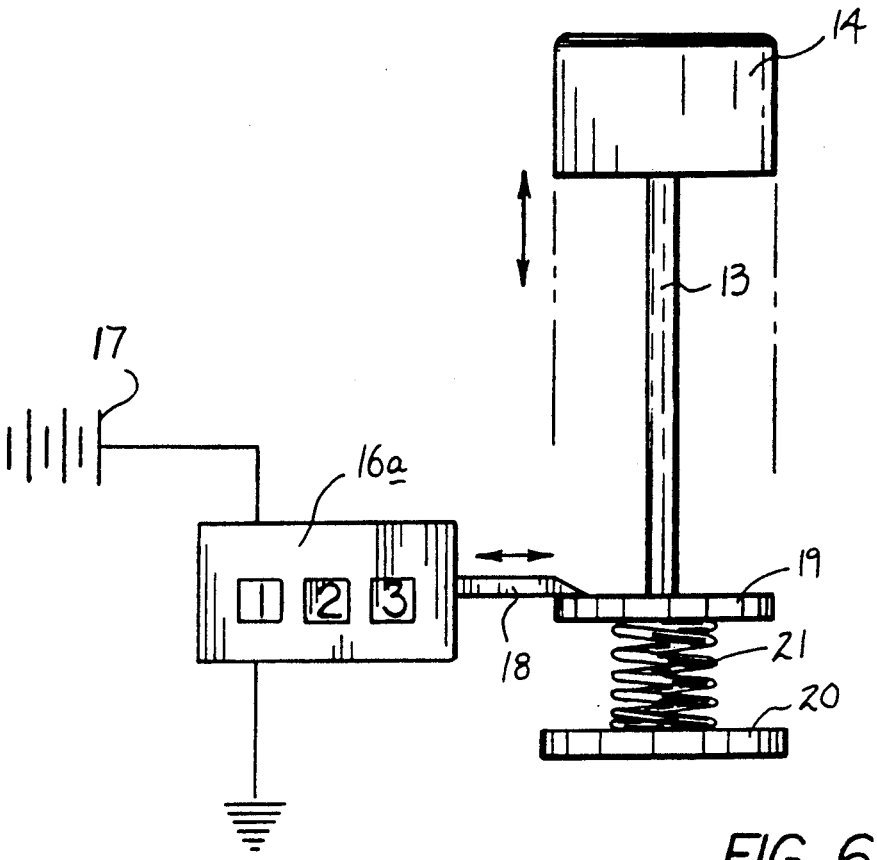
FIG. 5 is an orthographic diagrammatic illustration of the latch mechanism utilized by the instant invention.
Figure 9:
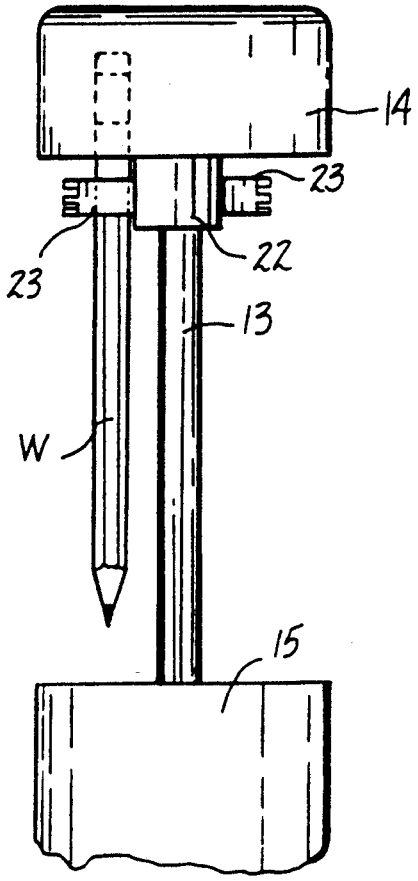
FIG. 9 is an orthographic side view, taken in elevation, of the writing instrument and spring clip in association with the magnetic storage member of the instant invention.

More specifically, the pen and pencil caddy apparatus 10 of the instant invention essentially comprises an elongate longitudinally aligned support housing 11, generally of a cylindrical configuration defining a support housing cavity 12 coextensively therethrough. The support housing 11 is fixedly mounted at its lowermost end to a support base 15, with a piston rod 13 coaxially projecting through the support housing reciprocatably mounted therewithin, with a cup-shaped hollow lock piston 14 fixedly mounted at an upper terminal end of the piston rod 13, wherein the piston rod is extensible to a first extended position, in a manner as illustrated in FIGS. 2 and 9 for example, and locked in a second retracted position, in a manner as illustrated in FIG. 4, to securably position various writing instruments within the support housing during periods of non-use. The support base 15 includes a code lock entry pad 16 projecting through the support base 15 to provide electrical communication to an associated solenoid **16*a* that is operative through an associated battery 17. The solenoid 16*a* includes a solenoid rod 18 that normally projects to an extended position, as illustrated in FIG. 5 for example, whereupon proper entry of a code within the code pad effects retraction of the solenoid rod 18 to a retracted position. The lower terminal end of the piston rod 13 includes a piston rod base plate 19 fixedly and coaxially mounted thereto in an orthogonal relationship, with a spring member 21 captured between the piston rod base plate 19 and a piston rod bottom base plate 20. The spring member 21 thereby effects extension of the piston rod 13 and the associated piston 14 to the first extended position upon retraction of the solenoid rod 18 to the retracted solenoid position. In this manner, selective access to the writing instruments contained within the support housing 11 are provided, in a manner as illustrated in FIG. 2**.

Figure 6:
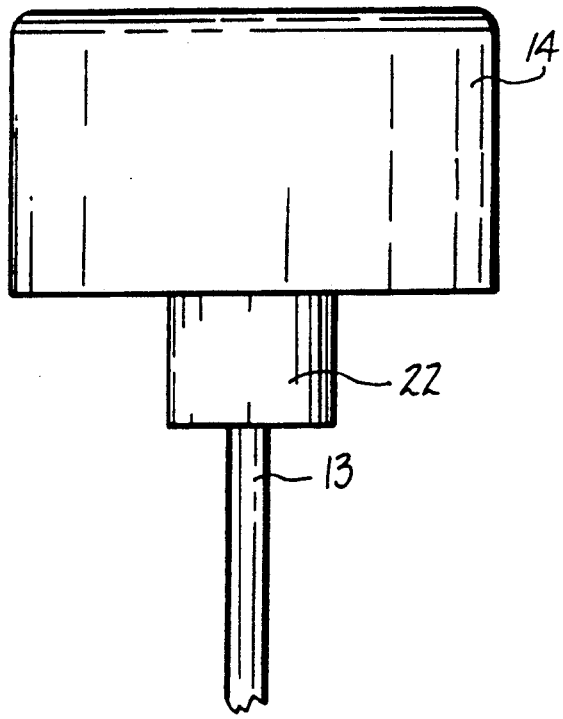
FIG. 6 is an orthographic side view, taken in elevation, somewhat enlarged, of the lock piston in use with a magnetic storage cylinder.
Figure 7:
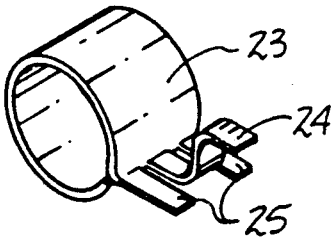
FIG. 7 is an isometric illustration of a spring clip utilized by the magnetic storage member of the instant invention.
Figure 8:
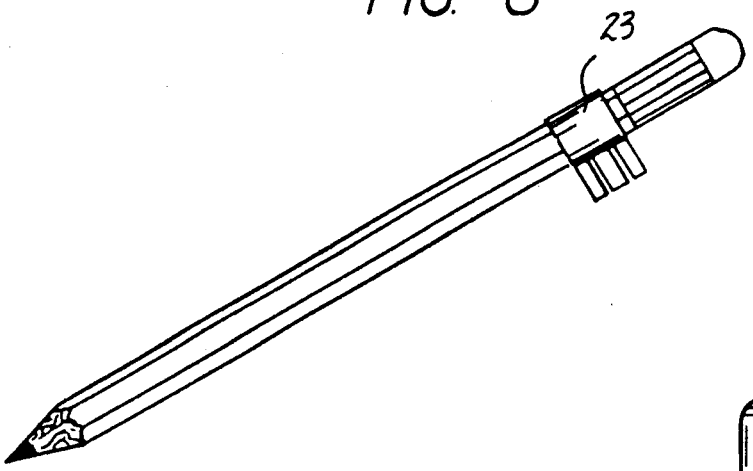
FIG. 8 is an orthographic side view of the spring clip in association with a writing instrument.

FIG. 6 illustrates the piston rod 13 and the associated piston 14, with a cylindrical magnet 22 fixedly and coaxially mounted about the piston rod 13 underlying the piston 14. The piston 14 is of a generally cup-shaped configuration and inverted to provide a piston cavity underlying a top surface of the piston. An annular spring clip 23, in a manner as illustrated in FIGS. 7, 8, and 9, is utilized, wherein the spring clip 23 is formed of a magnetically attractive material. It should be noted that the piston 14 and piston rod 13 are of a non-ferro magnetic attractive material. The spring clip 23 includes an "L" shaped top tang 24 cooperative with spaced lower tang member 25, whereupon manual projection of the top tang 24 between the spaced lower tang members 25 permits spreading of the spring clip for its securement about a writing instrument "W". In this manner, the writing instrument "W" is mounted upon the ferro magnet 22 for convenience of storage of the writing instrument thereon within the housing 15. Further, additional spring clip members 23 are provided for use with additional writing instruments and are thereby stored about the ferro magnet 22 which serves as a storage magnetic in use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A security writing instrument caddy apparatus comprising, a support housing, the support housing coaxially aligned and including a lower terminal end and an upper terminal end, the lower terminal end fixedly mounted to a support base, and lock means overlying the support housing at an upper edge coaxially aligned therewith from a first extended position to a second lowered position in communication with the upper edge, and wherein the lock means includes an inverted cup-shaped piston coaxially aligned overlying the upper edge of the support housing, with a piston rod, wherein the piston rod fixedly mounts the piston at an upper terminal end, and the piston rod extends coextensively and coaxially through the support housing and into the support base, and including latch means cooperative with a lower terminal end of the piston rod within the support base to permit extension of the piston rod from the second position to the first position, and wherein the lock means includes a piston rod top base plate fixedly and coaxially mounted to the lower terminal end of the piston rod and orthogonally oriented thereto spaced from a piston rod bottom base plate, with the piston rod bottom base plate mounted within the support base, and a spring member captured between the piston rod top base plate and the piston rod bottom base plate, and the lock further including a solenoid within the support base, and a solenoid rod retractable relative to the solenoid to an extended position to overlie the piston rod top base plate for securement of the piston in the second position and with the piston rod retracted to permit extension of the piston rod and piston to the first position.

2. An apparatus as set forth in claim 1 with a code lock entry pad directed through and exposed through the support base operative to effect retraction of the solenoid rod relative to the solenoid.

3. An apparatus as set forth in claim 2 with a ferro magnet mounted about the piston rod adjacent the upper terminal end of the piston rod underlying the piston, and the piston rod and piston formed of a non-ferro magnetic attractive material.

4. An apparatus as set forth in claim 3 including at least one spring clip for securement about a writing instrument, with the spring clip formed of a ferro magnetically attractive material for selective securement to the ferro magnet.

5. An apparatus as set forth in claim 4 wherein the spring clip includes an "L" shaped top tang spaced above spaced above a plurality of lower tang members, with the "L" shaped top tang member positioned medially of the lower tang members and displaceable between the lower tang members to permit securement of a writing instrument within the spring clip.

* * * * *